United States Patent [19]

Viscount

[11] 4,092,971

[45] June 6, 1978

[54] SELF-CONTAINED, MULTI-BLADE PACKAGE FOR SLURRY SAWS AND THE LIKE

[76] Inventor: Kenneth W. Viscount, 321 Cherry St., Carlisle, Pa. 17013

[21] Appl. No.: 737,128

[22] Filed: Oct. 29, 1976

[51] Int. Cl.[2] ..... B28D 1/06

[52] U.S. Cl. ..... 125/16 R; 83/662; 125/18

[58] Field of Search ..... 125/16, 17, 18, 19; 83/662

[56] References Cited

U.S. PATENT DOCUMENTS

| | | | |
|---|---|---|---|
| 3,845,541 | 11/1974 | Ranieri | 83/662 |
| 3,889,699 | 6/1975 | Ranieri | 125/16 R |

*Primary Examiner*—Harold D. Whitehead

*Attorney, Agent, or Firm*—Sughrue, Rothwell, Mion, Zinn and Macpeak

[57] ABSTRACT

A self-contained, multi-blade package is constructed to be mounted in the blade head assembly of a slurry saw for cutting hard materials such as quartz, silicon, germanium, and the like. The blade package is pre-assembled with connecting rods extending through aligned holes of spacer plates and end caps which extend above and below the blades at either end of the blades. At least one end cap of each pair is drilled with a through hole or holes and counter bored to receive a nut threaded on the connecting rod which projects into the counter bore. The end caps have a thickness on the order of one-half their width dimension resulting in great dimensional stability. This prevents distortion of the blade pack when the nuts are tightened on the connecting rods ensuring parallelism and rigidity of the blade package. The end caps further eliminate the need for clamping blocks normally used in the blade head assembly of slurry saws thereby permitting more blades to be incorporated in the blade package.

5 Claims, 12 Drawing Figures

SELF-CONTAINED, MULTI-BLADE PACKAGE FOR SLURRY SAWS AND THE LIKE

BACKGROUND OF THE INVENTION

The present invention generally relates to multiblade slurry saws and the like used for cutting hard materials such as quartz, silicon, germanium and the like, and more particularly to improvements in the self-contained multiblade package used in such saws.

In earlier multi-blade slurry saws or the like, it was the practice to assemble the individual blades and spacers onto the blade head assembly of the machine. Such a procedure was time consuming and required highly skilled workers. These problems have been obviated by the development of pre-assembled, self-contained, multi-blade packages which are designed to be quickly and easily mounted into the blade head assembly of the slurry saw. There are generally two approaches in the manufacture of such multi-blade packages. In one approach, the blades and spacers are assembled in a large and heavy precision jig, and the blades and spacers are secured together by epoxy or some other adhesive or bonding agent. The problem with this approach is that the blade package assembly must be carried in the jig until the curing of the bonding agent is complete. This requires additional jigs so that other blade packages can be assembled while the curing process of prior assembled blade packages is in progress. Moreover, the size of the blade packages made according to this approach is, as a practical matter, limited due to the size and weight of the jigs. In other words, there is a practical upper limit to the size and weight of a jig which can be conveniently moved from place to place, and this size and weight is directly related to the size of the blade package which can be assembled in a particular jig. These bonded blade packages are quite expensive due to the intensive labor required in their manufacture. The other approach in the manufacture of multiblade packages is to use connecting rods which extend through aligned holes of spacer plates and end plates at either end of the blades. These are known as pinned blade packages and have the advantage of being quite inexpensive to manufacture, costing on the order of one-half the cost bonded multiblade packages. The prior art pinned blade package, however, generally does not perform as well as the bonded blade package and can not be manufactured to the same close tolerances of the bonded blade package. The blade packages assembled according to either of the foregoing approaches have required clamping blocks on either side at both ends of the blade package to facilitate the clamping of the blade package into the head of the slurry saw. In the past, these clamping blocks had to be removed from the blade head assembly of the saw and carefully cleaned and replaced with each change of blade packages. This can be a time consuming process. Moreover, the dimensions of the clamping blocks are such that they limit the number of blades in a blade package that can be accomodated in a given blade head assembly.

SUMMARY OF THE INVENTION

The present invention is to improvements in self-contained, multi-blade packages which result in blade packages which are constructed in the manner of pinned blade packages but have the superior characteristics generally associated with the bonded blade packages. According to the present invention, the multi-blade package is pre-assembled in an inexpensive jig with connecting rods extending through aligned holes of spacer plates and thick end caps which extend above and below the blades. The end caps have thicknesses on the order of one-half their width dimension which make them highly stable dimensionally. At least one end cap of each pair is through drilled and counter bored to receive a nut which is threaded onto the connecting rod end which projects into the counter bore. Once the blade package has been assembled, it can be immediately removed from the jig thereby freeing the jig for assembly of another blade package and eliminating the need to carry the blade package assembly in the jig. Using these thick end caps, the tolerances of the manufactured blade packages are greatly improved over those heretofore known with pinned blade packages. The thick end caps prevent distortion of the blade package when the nuts are tightened on the connecting rods thereby ensuring parallelism and rigidity of the completed blade package. Moreover, the thick end caps eliminate the need for clamping blocks which are normally used in the blade head assemblies of slurry saws. This permits the use of blade packages having more blades and facilitates the change of blade packages in the blade head assembly. The invention therefore provides a superior blade package at low cost which is easy to use.

BRIEF DESCRIPTION OF THE DRAWINGS

The specific nature of the invention, as well as other objects, aspects, uses and advantages thereof, will clearly appear from the following description and from the accompanying drawings, in which.

DESCRIPTION OF THE PREFERRED EMBODIMENT

Figure 1:
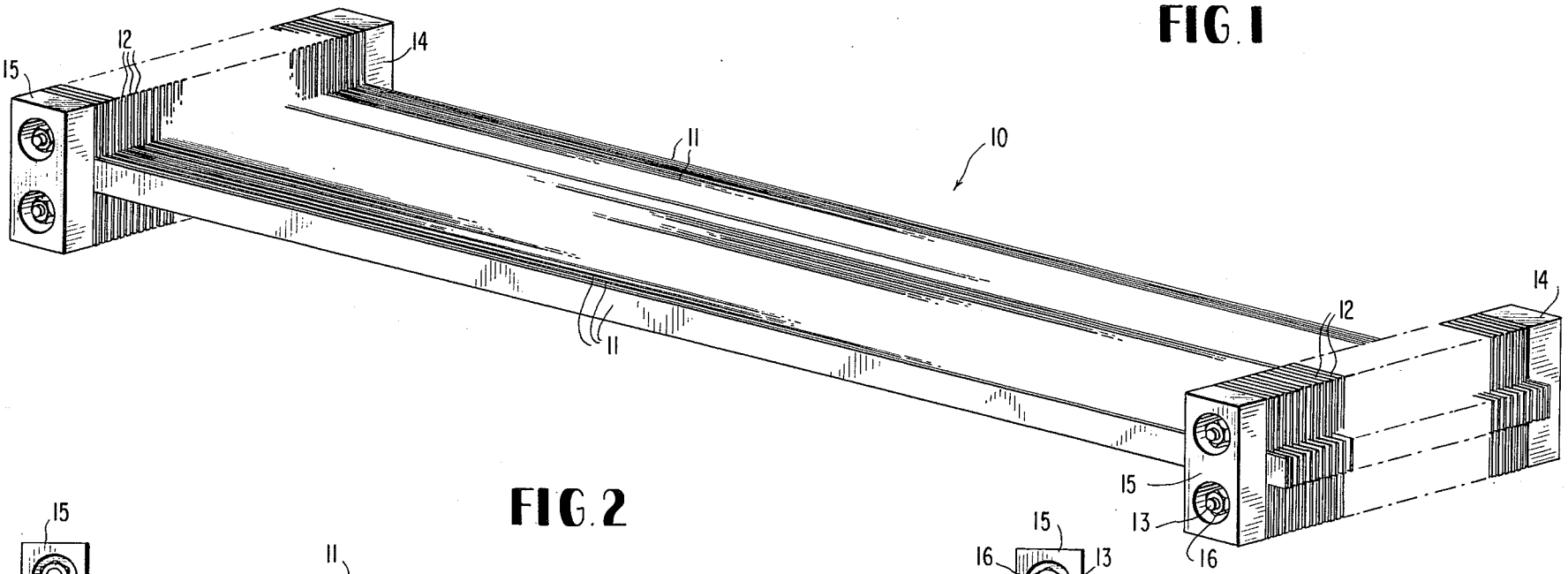
FIG. 1 is a pictorial view illustrating a preferred embodiment of a multi-blade package manufactured according to the present invention.
Figure 2:
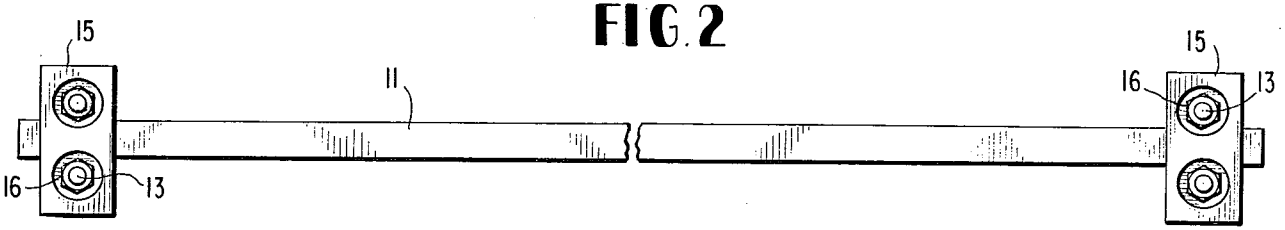
FIG. 2 is a side view of the blade package illustrated in FIG. 1.
Figure 3A:
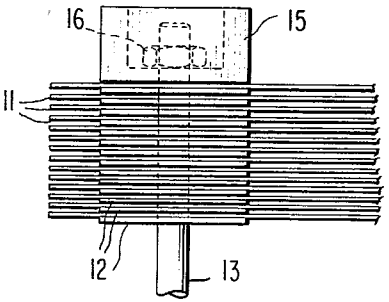
FIG. 3A is a detailed view illustrating one end cap in the assembled blade package.
Figure 3:
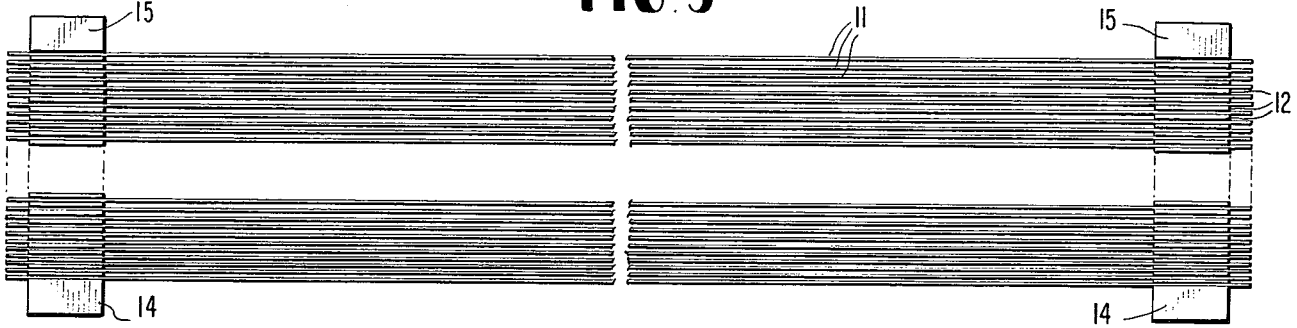
FIG. 3 is a plan view of the blade package illustrated in FIG. 1.

Referring now to the drawings wherein like reference numerals refer to like or corresponding elements throughout several views, FIG. 1 illustrates a multi-blade package 10 which embodies features of the present invention. More specifically, the blade package comprises a multiplicity of elongated relatively narrow blades 11 separated at either end by a series of flat spacers 12. As may be seen in more detail in FIGS. 2, 3, and 3A, connecting rods 13 extend through aligned holes in the spacers 12 on either side of the blades 11. In this embodiment, one end of the connecting rods 13 is threaded into a thick end cap 14 of a pair of end caps.

The second end cap 15 of the pair of end caps is through drilled to receive the connecting rods 13 and counter bored to accept a nut 16 threaded onto the end of the connecting rod projecting into the counter bore. Those skilled in the art will recognize that modifications can be made to the end caps of the assembly shown in FIGS. 1, 2 and 3. For example, both end caps of each pair could be provided with through drilled holes which are counter bored. In this case, nuts would be threaded onto both ends of each connecting rod. Alternatively, the connecting rods could be made integral with the end cap 14 of each pair. This could be done, for example, by welding, casting, or some other conventional technique.

Figure 6:
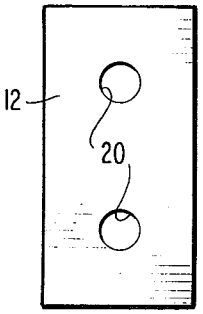
FIG. 6 is a plan view of a spacer.
Figure 4A:
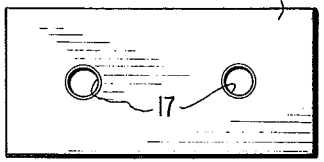
FIGS. 4A and 4B are plan and end views, respectively, of the threaded end cap of an end cap pair.
Figure 5A:
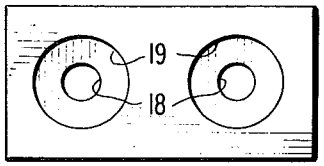
FIGS. 5A and 5B are plan and end views, respectively, of the through drilled and counter bored end cap of an end cap pair.
Figure 4B:
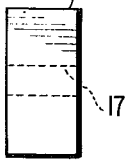
Figure 5B:
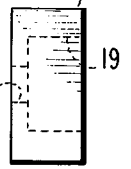

FIGS. 4A and 4B show in more detail the end cap 14. This end cap is provided with two threaded holes 17 to accept threaded ends of connecting rods 13. FIGS. 5A and 5B show the details of the end cap 15. This end cap is through drilled at 18 in alignment with the threaded holes 17 of end cap 14. In addition, end cap 15 is provided with counter bores 19 which are axially aligned with the through drilled holes 18. As will be appreciated from these figures, the end caps 14 and 15 are relatively thick having a thickness dimension which approximates one-half the width dimension of the end caps. In contrast, the spacers 12 shown in plan view in FIG. 6 are relatively thin. These spacers are provided with through drilled holes 20 in alignment with the holes 17 of the end cap 14 and the holes 18 of the end cap 15.

An inexpensive jig may be used in the assembly of the blade package. More particularly, in the assembly of the multi-blade package according to the invention as illustrated in FIG. 1, for example, the connecting rods 13 are first threaded into the end cap 14. The blades 11 and spacers 12 are then assembled over the connecting rod 13. End caps 15 are then placed over the assemblies at either end with the connecting rods 13 projecting into the counter bores 19 of the end caps 15. Nuts 16 are then threaded into the ends of the connecting rods projecting into the counter bores of end caps 15 and tightened. The thickness of the end caps 14 and 15 prevents distortion of the blade package when the nuts 16 are tightened onto the connecting rods 13. The result is a pinned blade package having greatly improved tolerances and superior cutting characteristics than heretofore known, yet easily and inexpensively manufactured. Moreover, the thick end caps 14 and 15 eliminate the need for clamping blocks normally used n the head assemblies of slurry saws and the like. In effect, the end caps of the present invention act as an integral clamping block and end plate in the blade package. Thus, by eliminating the clamping blocks which are normally used with the blade package, more blades can be used in each blade package for a given blade head assembly.

Figure 7:
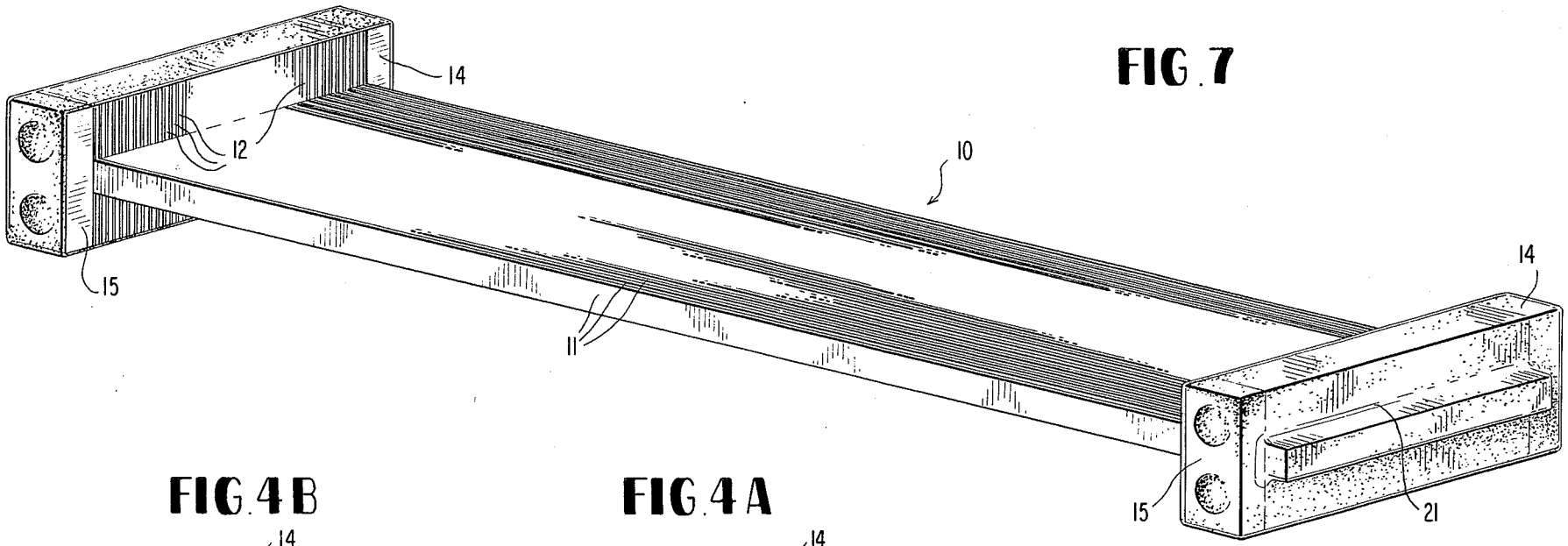
FIG. 7 is a pictorial view illustrating the blade package of FIG. 1 with the spaces between the spacer plates bonded together with an epoxy or other adhesive.

While the blade package illustrated in FIG. 1 is highly satisfactory in both manufacture and use, even greater rigidity with improved package tolerances can be achieved by filling the spaces between the spacers 12 and the ends of the blades 11 with an epoxy or other bonding agent as indicated in FIG. 7 by the reference numeral 21. This pinned and bonded blade package has all of the advantages of the bonded blade package yet requires neither the heavy precision jigs or intensive labor required in the manufacture of bonded blade packages.

Figure 8:
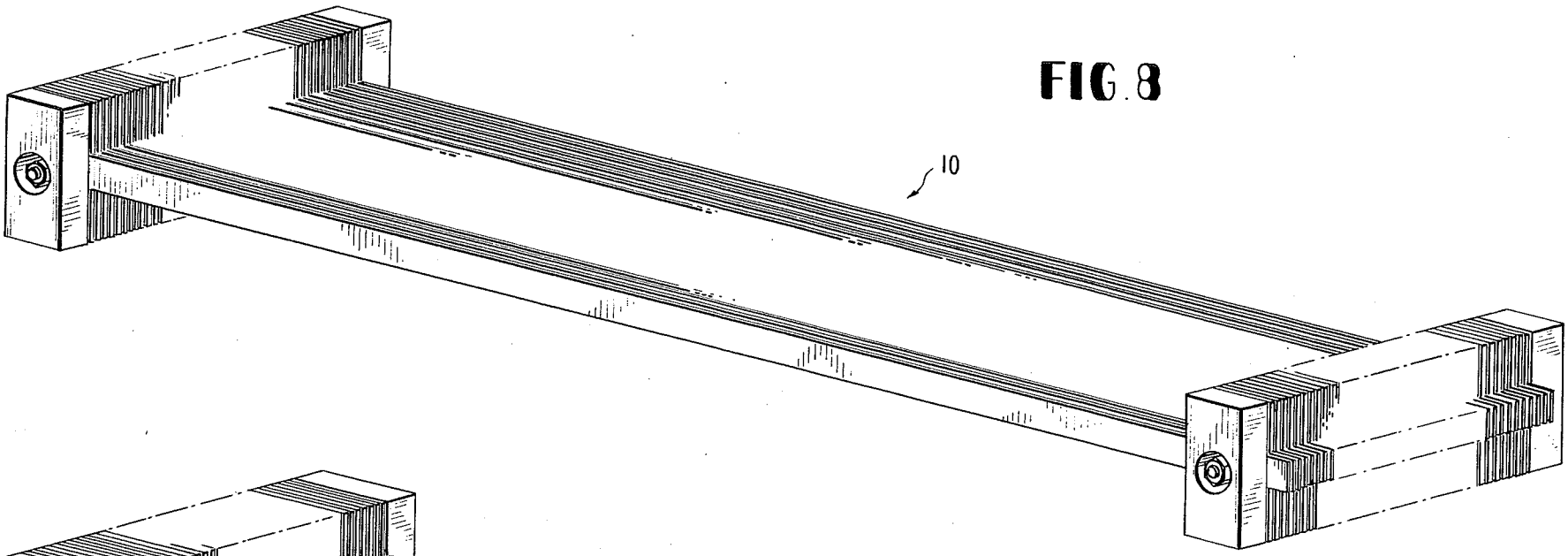
FIGS. 8 and 9 are pictorial views illustrating alternatives embodiments of the invention.
Figure 9:
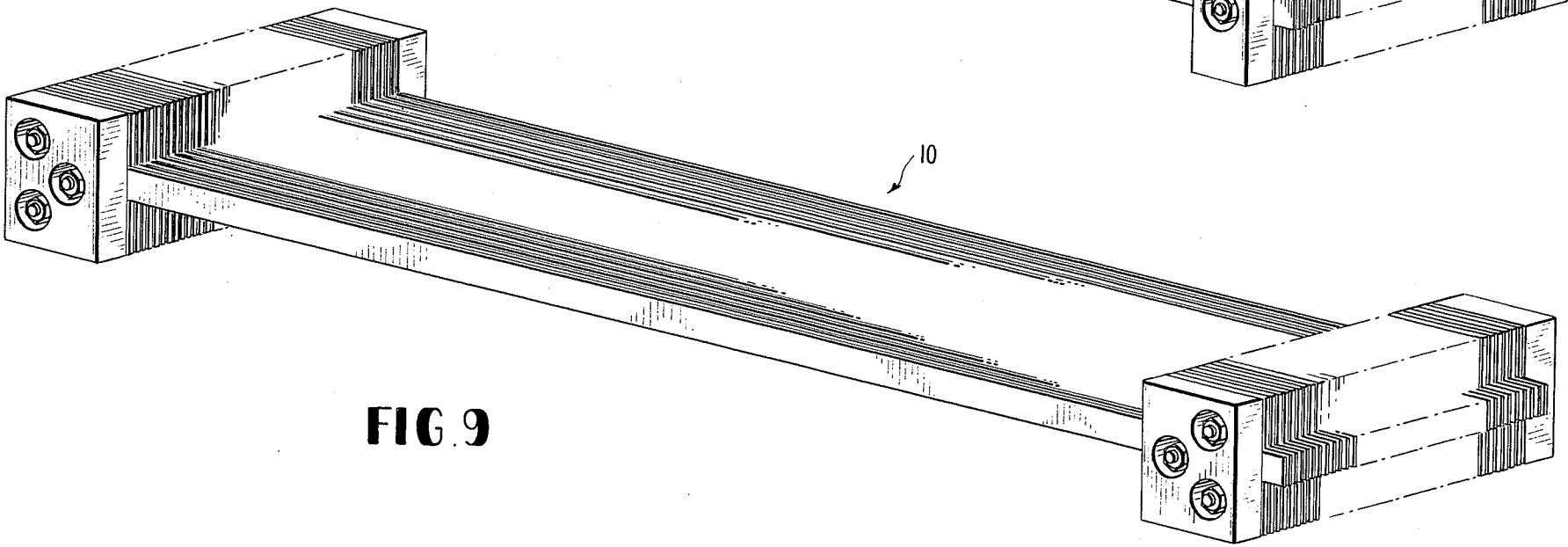

The embodiments shown in FIGS. 1 and 7 employ two connecting rods at either end of the blade package. These connecting rods extend through aligned holes in the spaces 12 on wither side of the blades 11. The advantage of the invention may be realized, however, by using only one connecting rod at either end of the blade package as shown in FIG. 8 of three connecting rods at either end of the blade package as shown in FIG. 9. In FIG. 8, the single connecting rod passes through aligned holes in the ends of the blades 11 as well as the spacers 12. The use of three connecting rods as shown in FIG. 9 may be considered a combination of the embodiments of FIGS. 1 and 8. In general, however, the use of two connecting rods with the thick end caps at either end of the blade package as illustrated in FIG. 1 is preferred since holes do not have to be made in the blades. Such holes tend to weaken the blades and require deburring which is an extra step in the manufacturing process. Again, the rigidity of the structures shown in FIGS. 8 and 9, with or without the thick end caps 14 and 15, can be improved by epoxying or otherwise bonding the spaces between the spacers 12 and the ends of the blades 11 as described with respect to FIG. 7.

It will be apparent, therefore, that the embodiments shown are only exemplary and that various modifications can be made in construction and arrangement within the scope of the invention as defined in the appended claims.

What is claimed is:

1. A self-contained, multi-blade package for use in the blade head assembly of a slurry saw or the like, comprising:

a plurality of elongated, thin blades in spaced, parallel array, first and second pluralities of thin, flat spacers inserted at either end between said blades and having aligned holes therein, at least a first connecting rod extending through aligned holes in said first plurality of spacers, at least a second connecting rod extending through aligned holes in said second plurality of spacers, two pairs of relatively thick end caps, at least one end cap of each pair having at least one through drilled hole and being counter bored on one face with one end of a connecting rod extending through the through drilled hole into the counter bore, said relatively thick end caps each having a thickness which approximates one-half the width dimension of the end cap, and at least first and second nuts threaded, respectively, onto the ends of said first and second connecting rods extending into the counter bores of the end caps and being fully received within the recesses formed by said counter bores, said relatively thick end caps preventing distortion of the blade package when said nuts are tightened on said connecting rods thereby ensuring the rigidity and parallelism of the package and serving the function of clamping blocks in the blade head assembly of a slurry saw or the like.

2. A self-contained, multi-blade package as recited in claim 1 comprising third and fourth connecting rods extending through aligned holes in said first and second pluralities of spacers, respectively, said first and second connecting rods and said second and fourth connecting rods being located on either side of said blades, said at least one end cap of each pair having at least two through drilled holes both of which are counter bored on one face with one end of said first and third connecting rods or said second and fourth connecting rods extending through the through drilled holes into the counter bores, and third and fourth nuts threaded, respectively, onto the ends of said third and fourth connecting rods extending into the counter bores of the end caps.

3. A self-contained, multi-blade package as recited in claim 1 wherein said first and second connecting rods extend through aligned holes in the ends of said blades.

4. A self-contained, multi-blade package as recited in claim 2 comprising fifth and sixth connecting rods extending through aligned holes in said first and second plurality of spacers, respectively, and also extending through aligned holes in said blades, said at least one end cap of each pair having through drilled holes all of which are counter bored on one face with one end of said first and fifth connecting rods or said second, fourth and sixth connecting rods extending through the through drilled holes into the counter bores, and fifth and sixth nuts threaded, respectively, onto the ends of said fifth and sixth connecting rods extending into the counter bores of the end caps.

5. A self-contained, multi-blade package as recited in claim 1 wherein said first and second connecting rods are threaded at both ends and one end cap of each pair has a threaded hole with one end of a connecting rod being threaded therein.

* * * * *